US005997449A

United States Patent [19]

Lee

[11] Patent Number: 5,997,449

[45] Date of Patent: Dec. 7, 1999

[54] STRUCTURE OF A HULA-HOOP

[76] Inventor: Joseph Chen Lung Lee, P.O. Box 82-144, Taipei, Taiwan

[21] Appl. No.: 09/059,035

[22] Filed: Apr. 13, 1998

[51] Int. Cl.[6] ..... A61H 15/00

[52] U.S. Cl. ..... 482/131; 446/236; 601/118; 601/132

[58] Field of Search ..... 482/131; 601/118, 601/132; 446/236

[56] References Cited

U.S. PATENT DOCUMENTS

| | | | |
|---|---|---|---|
| 4,052,982 | 10/1977 | Ozeryansky | 128/57 |
| 4,191,179 | 3/1980 | Mattila | 128/58 |
| 4,380,885 | 4/1983 | Komagata | 46/220 |
| 5,492,526 | 2/1996 | Chen | 601/132 |
| 5,676,638 | 10/1997 | Shefi | 601/124 |

*Primary Examiner*—Jerome W. Donnelly
*Assistant Examiner*—Tam Nguyen
*Attorney, Agent, or Firm*—A & J

[57] ABSTRACT

A hula-hoop includes a body having a hollow portion at an inner side thereof, and a plurality of rollers equi-distantly spaced apart and pivotally mounted in the hollow portion of the hula-hoop body. The rollers are covered by a soft outer sleeve and each roller projects slightly from the inner side of the hula-hoop body. When the user turns the hula-hoop at the waist portion, the rollers may enhance the turning of the hula-hoop, and may prevent possible injury to the waist portion. The hula-hoop is easy to dismantle and assemble to facilitate carrying. Additionally, the rollers may massage the waist of the user during play.

1 Claim, 2 Drawing Sheets

STRUCTURE OF A HULA-HOOP

BACKGROUND OF THE INVENTION

1. Field of the Invention

The present invention relates generally to an improved structure of a hula-hoop, and more particularly to a hula-hoop which is provided with soft rollers to prevent possible injury to the waist and back of the user. The rollers enhance the smooth turning of the hula-hoop which provides excellent massaging effects. Additionally, the hula-hoop of the present invention is easy to dismantle and assemble as well as convenient to carry.

2. Description of the Prior Art

Modern people often work under pressure. Lack of proper exercises may result in poor physical condition such as poor blood circulation, sore back, sore waist, etc. There are available on the market various types of exercising apparatuses to help exercise certain parts of the body. But few of them are directed to exercise the waist and back areas of the user. Although there are available twisting or swinging machines, they are mostly mechanically operated or electrically powered, which may make the user physically unwell.

One of the most convenient waist exerciser is the hula-hoop. The user twists his/her hips and waist to keep the hula-hoop turning round and round at the waist. Such exercise is not only entertaining but it can also help shape the waist muscle. As is known, the hula-hoop is generally made of plastics, which may hurt the bones at the waist when the user twists. It is therefore desirable to have a hula-hoop that will not hurt or injure the user's body during play.

SUMMARY OF THE INVENTION

The present invention relates generally to an improved structure of a hula-hoop, and more particularly to a hula-hoop which is provided with soft rollers to prevent possible injury to the waist and back of the user. The rollers also enhance the smooth turning of the hula-hoop and which provides excellent massaging effects. Besides, the hula-hoop of the present invention is easy to dismantle and assemble as well as convenient to carry.

A primary object of the present invention is to provide an improved structure of a hula-hoop, wherein the hula-hoop is easier to manipulate and will not injure the user's body when it is turned at the waist. Furthermore, the hula-hoop of the present invention has massaging effects.

Another object of the present invention is to provide an improved structure of a hula-hoop, which is easy to assemble and disassemble to facilitate carrying.

In order to achieve the above-mentioned objects, the present invention comprises a hula-hoop body having a hollow portion at an inner side thereof, and a plurality of rollers equi-distantly spaced apart and pivotally mounted in the hollow portion, the rollers each being covered by a soft outer sleeve. The rollers are provided to facilitate the turning of the hula-hoop, avoid possible injury to the user's waist, and massage the user's waist. The hula-hoop body may include a plurality of curved hula-hoop portions interconnected by means of retaining posts and through holes formed at the ends thereof so that the hula-hoop body is easy to assemble and dismantle.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
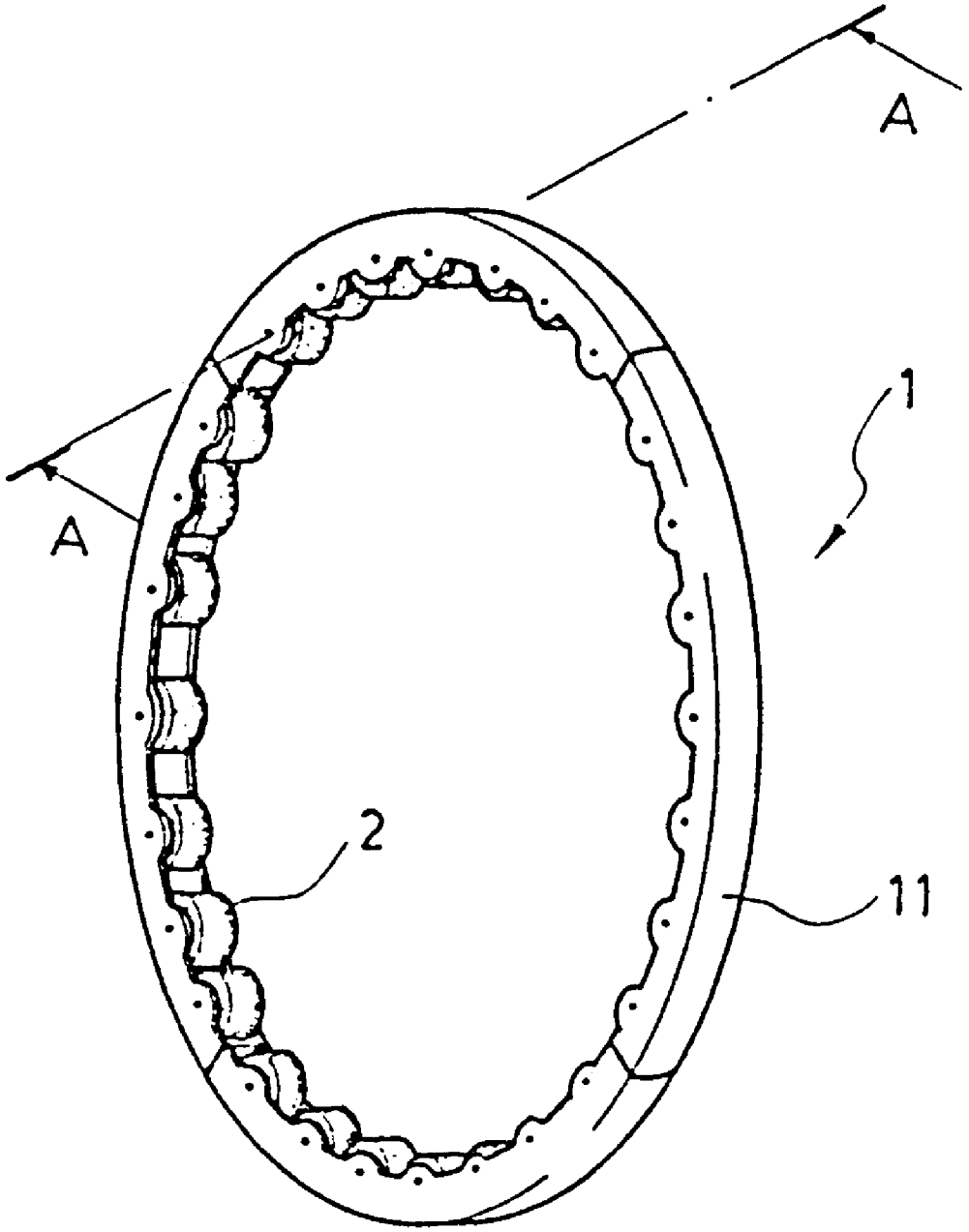
FIG. 1 is a schematic perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, the present invention essentially comprises a hula-hoop body 1 that includes a plurality of curved hula-hoop body portions 11. In the embodiment shown in the drawings, there are four curved hula-hoop body portions. A plurality of soft rollers 2 is equidistantly spaced apart in an inner rim of the hula-hoop body 1.

Figure 2:
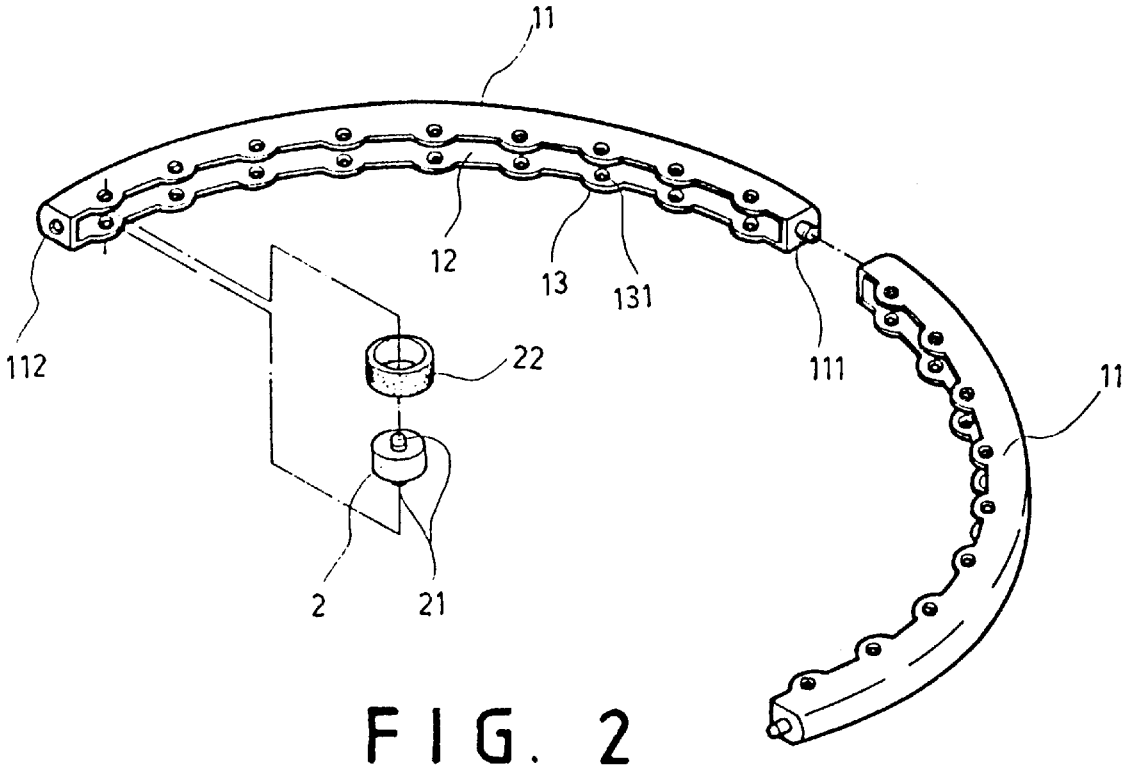
FIG. 2 is a schematic perspective exploded view of the hula-hoop body according to the present invention.
Figure 3:
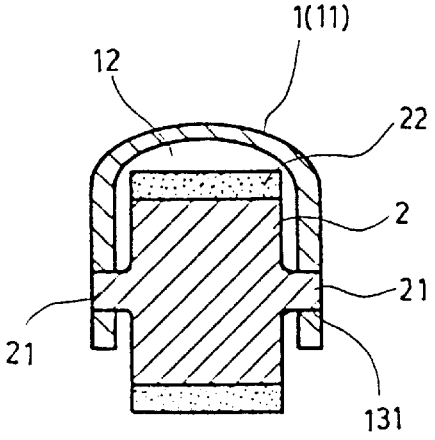
FIG. 3 is a schematic sectional view of the hula-hoop body taken along line A—A of FIG. 1.

Referring to FIGS. 2 and 3, the hula-hoop body 1 has a hollow portion 12 at its inner side. Pairs of symmetrical curved plates 13 respectively extend from upper and lower rims of the hollow portion 12 at the inner side of the hula-hoop body 1 above and below the hollow portion 12. Each curved plate 13 has a through hole 131. Each roller 2 has posts 21 respectively extending from upper and lower sides thereof. Each roller 2 is pivotally mounted at each pair of curved plates 13 by forcing the posts 21 into the through holes 131. An outer sleeve 22 of a soft material such as foamed plastic envelops the outer surface of each roller 2. In addition, each curved hula-hoop body portion 11 has a retaining post 111 extending from one end thereof while the other end thereof is provided with a through hole 112 for engaging the retaining post 111 of an adjacent curved hula-hoop body portion 11. During assembly, the curved hula-hoop body portions 11 are inter-connected by means of inserting the retaining post 111 of one curved hula-hoop body portion 11 into the through hole 112 of another curved hula-hoop body portion 11. When assembling the last two curved hula-hoop body portions 11, the retaining post 11 of one curved hula-hoop body portion 11 is forced into the through hole 112 of the other curved hula-hoop body portion 11. In this way, the curved hula-hoop body portions 11 are tightly connected to form the hula-hoop body 1 and may not easily become disengaged. After playing, when it is desirable to dismantle the hula-hoop body 1, it is only necessary to apply a suitable force at the joints between curved hula-hoop body portions 11. Certainly, the hula-hoop body 1 may comprise less or more than four curved hula-hoop body portions 11 to achieve the same functions and effects.

When the hula-hoop body 1 of the present invention is used in exercising the waist, the rollers 2 may rotate at the waist of the user so that it is easier to turn the hula-hoop body 1 around the waist of the user. By turning the hula-hoop body 1 at the waist, the user may use his/her waist to turn about 360 degrees in a stable fashion so that the muscles and bones at the waist portion of the body are strengthened. The spaces between rollers 2 may be configured to match the body contour. Furthermore, since the rollers 2 are provided with soft outer sleeves 22, they will not hurt the waist of the user but will instead provide a massaging effect.

In summary, the improved structure of a hula-hoop according to the present invention has the following advantages:

1. Simple in construction and easy to manufacture.

2. Very simple to dismantle and convenient to carry around.

3. Easier to turn since the hula-hoop body is provided with soft rollers pivotally mounted at its inner side, the rollers providing a massaging effect and avoiding possible injury to the user's bones and muscles at the waist.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A structure of a hula-hoop, comprising a hula-hoop body including a plurality of curved hula-hoop body portions and a plurality of rollers, wherein each of said curved hula-hoop body portion has a hollow portion at an inner side thereof, said hollow portion having an upper rim and a lower rim which extend outwardly to form a plurality of parallel and corresponding curved plates, each curved plate being formed with a through hole, said rollers being equi-distantly spaced apart in said hollow portion and being respectively mounted at said through holes of said curved plates, each of said rollers being enveloped by an outer sleeve of a soft material, said curved hula-hoop body portions each further having a retaining post at one end thereof and a through hole at the other end thereof, whereby said curved hula-hoop body portions are inter-connected to form said hula-hoop body by means of inserting the retaining post of one curved hula-hoop body portion into the through hole of the other curved hula-hoop body portion.

* * * * *